US005482273A

United States Patent [19]

Wilton

[11] Patent Number: 5,482,273

[45] Date of Patent: Jan. 9, 1996

[54] LACROSSE GAME TABLE

[76] Inventor: Curtis L. Wilton, 11503 Frederick Farms Cir., Midlothian, Va. 23112

[21] Appl. No.: 413,171

[22] Filed: Mar. 29, 1995

[51] Int. Cl.[6] ..... A63F 7/06

[52] U.S. Cl. ..... 273/85 D

[58] Field of Search ..... 273/85 R, 85 C, 273/85 D, 85 E

[56] References Cited

U.S. PATENT DOCUMENTS

| | | | |
|---|---|---|---|
| 1,319,372 | 10/1919 | Biertuempfel | 273/85 C |
| 1,934,381 | 11/1933 | Slosson | 273/85 D |
| 2,215,687 | 9/1940 | Carter | 273/85 D |
| 2,282,846 | 3/1941 | Barbot et al. | 273/85 D |
| 3,480,277 | 11/1969 | Fraser | 273/85 D X |
| 3,574,350 | 4/1971 | May | 273/85 D |
| 3,901,508 | 8/1975 | Spangler | 273/85 C |
| 3,926,432 | 12/1975 | Furr et al. | 273/85 D |
| 3,977,675 | 8/1976 | Leuthy, Jr. | 273/85 D |
| 4,009,881 | 3/1977 | Potter III | 273/85 E |
| 4,076,243 | 2/1978 | Davis | 273/85 E |
| 4,078,797 | 3/1978 | Bergee | 273/85 D |
| 4,260,152 | 4/1981 | Karlsen | 273/85 D |
| 5,275,401 | 1/1994 | Llorens | 273/85 B |
| 5,326,102 | 7/1994 | Chang | 273/85 D |

*Primary Examiner*—William H. Grieb
*Attorney, Agent, or Firm*—Donald A. Kettlestrings

[57] ABSTRACT

A lacrosse game table apparatus defines a playing field having a plurality of spaced-apart, side-by-side playing field sections oriented at various slopes with respect to horizontal to facilitate movement of a game ball by gravity across the playing field. A plurality of actuating rods are provided between the playing field sections for manipulation by the players. Manipulation of the rods moves ball control devices attached to the rods and configured in the manner of conventional lacrosse sticks over the playing field. Ball-receiving goal devices are positioned at opposed ends of the playing field. Movement of the ball control devices by the players can pick or scoop up a game ball from the playing field to hold the game ball, and the ball control devices can propel a game ball through the air toward the goal devices or to other ball control devices without touching the playing field to simulate a real lacrosse game.

27 Claims, 5 Drawing Sheets

LACROSSE GAME TABLE

BACKGROUND OF THE INVENTION

This invention relates to a game table and more particularly to a lacrosse game table apparatus which simulates a real lacrosse game.

Various types of games and game tables are known which simulate different types of sports, such as soccer, hockey and basketball. None of these games, however, provides a lacrosse game table which provides ball control devices configured in the manner of simulated real lacrosse sticks for enabling a game ball to be propelled or passed through the air and caught by the simulated lacrosse sticks in a manner similar to the action of real lacrosse sticks in the sport of lacrosse. Further, none of the known games or game tables provides a playing field which has a plurality of spaced-apart, side-by-side playing field sections which are sloped at various angles with respect to horizontal to facilitate movement by gravity of a lacrosse game ball over the game's playing field and which enables the simulated lacrosse sticks to pick or scoop up the ball from the playing field surface in a manner similar to the action of real lacrosse sticks in the sport of lacrosse.

It is, therefore, an object of the present invention to provide a lacrosse game apparatus which simulates the sport of lacrosse.

Another object is to provide a lacrosse game table which is provided with a playing field having a plurality of spaced-apart, side-by-side playing field sections which facilitate movement of a game ball over the playing field by the force of gravity.

A further object of the invention is the provision of a lacrosse game table apparatus which enables simulated lacrosse stick ball control devices to scoop up a game ball and to pass the game ball through the air to be received and caught by another simulated lacrosse stick ball control device in a manner similar to the real sport of lacrosse.

Still another object is to provide a lacrosse game table apparatus which provides for the simulated lacrosse stick ball control devices of opposing players to selectively contact each other to permit checking or striking of an opponent's ball control device to dislodge a game ball or to disrupt passes or shots of an opponent in the manner of the real sport of lacrosse.

Yet another object of the present invention is the provision of a lacrosse game table apparatus wherein the simulated lacrosse sticks of the apparatus are configured to pick up a game ball, catch a game ball propelled through the air, propel a game ball and to hold a game ball in a manner similar to lacrosse sticks as they are used in the real sport of lacrosse.

Another object is to provide such an apparatus which enables the simulated miniature lacrosse stick ball control devices to catch and shoot a game ball at a ball-receiving goal device in one motion, as can be done with a real lacrosse stick in the real sport of lacrosse.

Another object is to provide such an apparatus which provides simulated lacrosse stick ball control devices which are positioned immediately in front of ball-receiving goal devices for blocking shots at the goal devices and for directing a game ball to the game's playing field and to other defensive ball control devices.

Yet another object of the present invention is the provision of a lacrosse game table apparatus which enables the ball control devices configured in the manner of conventional lacrosse sticks to pass a game ball through the air to other ball control devices which can catch the game ball in the air without the game ball contacting the playing field surface, as can be done in the real sport of lacrosse.

A still further object is to provide a lacrosse game table apparatus which simulates many of the skills and features of the real team sport of lacrosse, including goalie play, defensive play, ground balls, pick-ups, scooping, passing, catching and shooting on goal.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a lacrosse game apparatus comprising: a playing field having first and second opposed ends; first and second opposed side walls connected to and extending upwardly above the playing field; first and second opposed end walls connected to and extending between the side walls; a plurality of actuating rods rotatably positioned within, extending between and slideably extending through the side walls; at least one ball control device fixedly attached to each of the actuating rods; the playing field including a plurality of spaced-apart, side-by-side playing field sections connected to the side walls; the actuating rods positioned one each substantially directly between adjacent ones of the playing field sections; and first and second ball-receiving goal devices positioned, respectively, at the opposed ends of the playing fields.

The playing field sections include: a first horizontal playing field section positioned at a substantially mid-field area of the playing field; and a plurality of additional playing field sections sloped with respect to horizontal to facilitate movement by gravity of a game ball over the playing field during playing of the game apparatus.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENT

Figure 1:
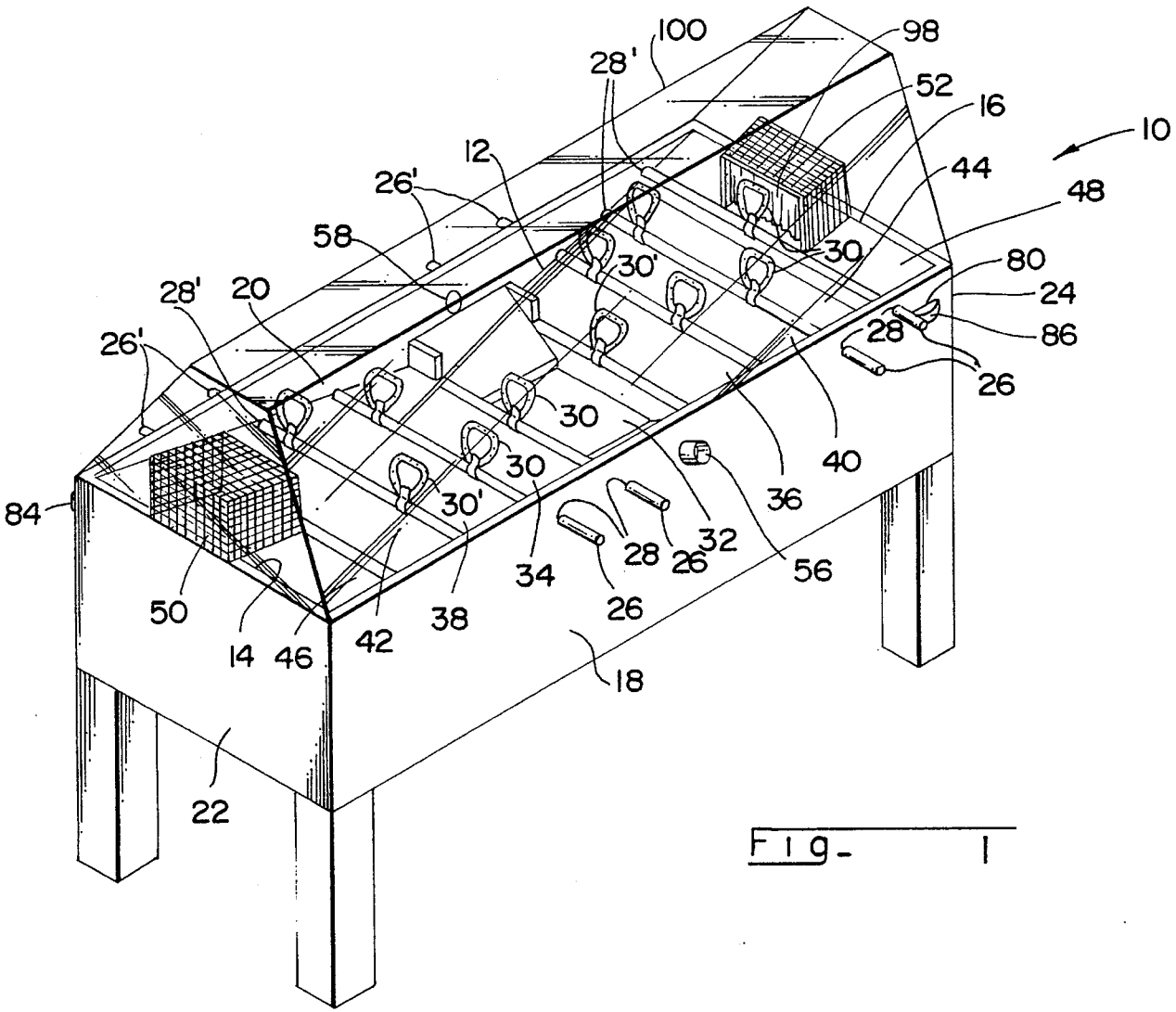
FIG. 1 is a perspective view of the apparatus of this invention.
Figure 2:
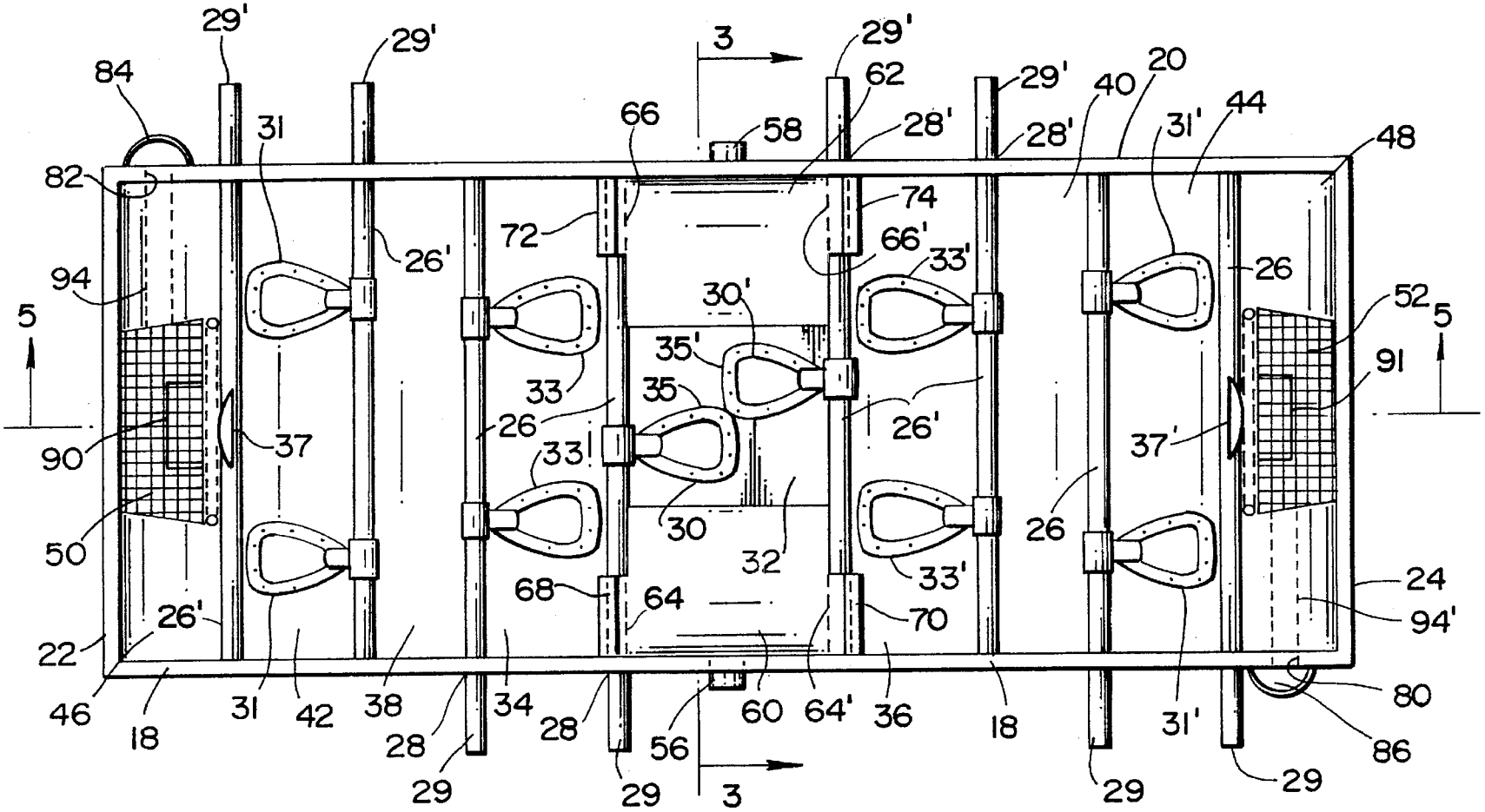
FIG. 2 is a top plan view of the apparatus.
Figure 4:
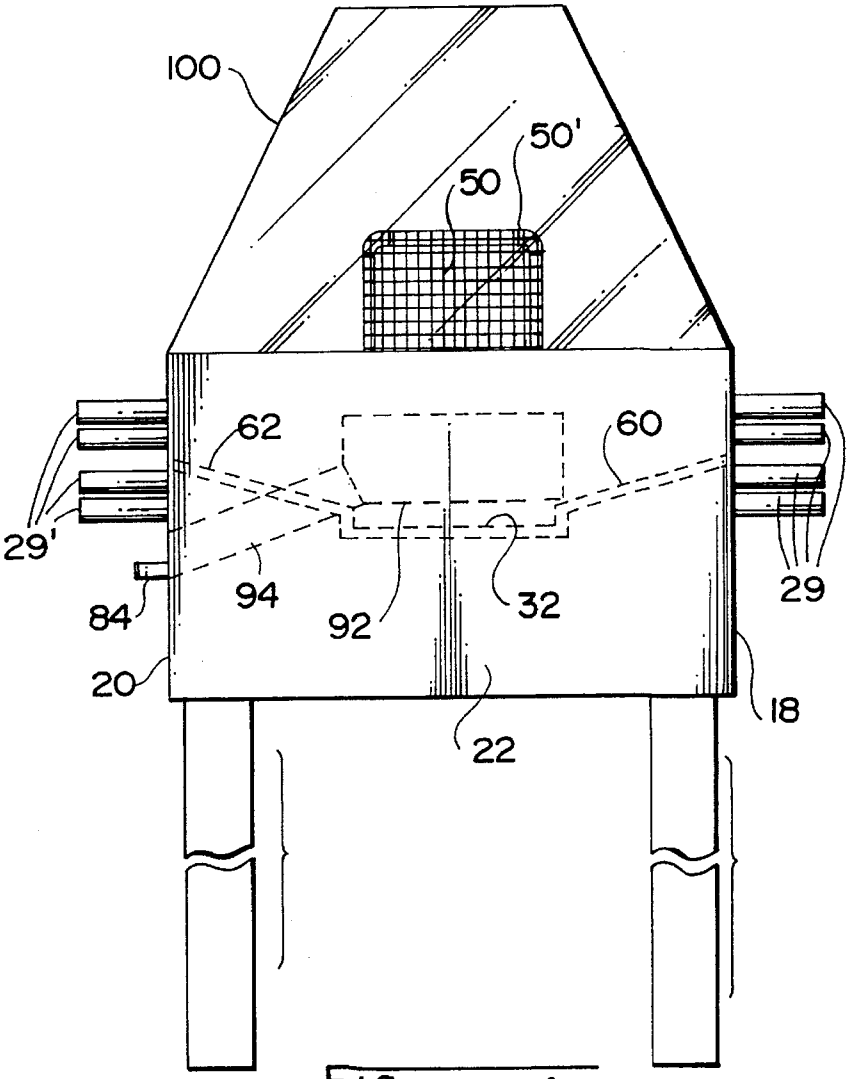
FIG. 4 is an end elevation view of the apparatus.
Figure 3:
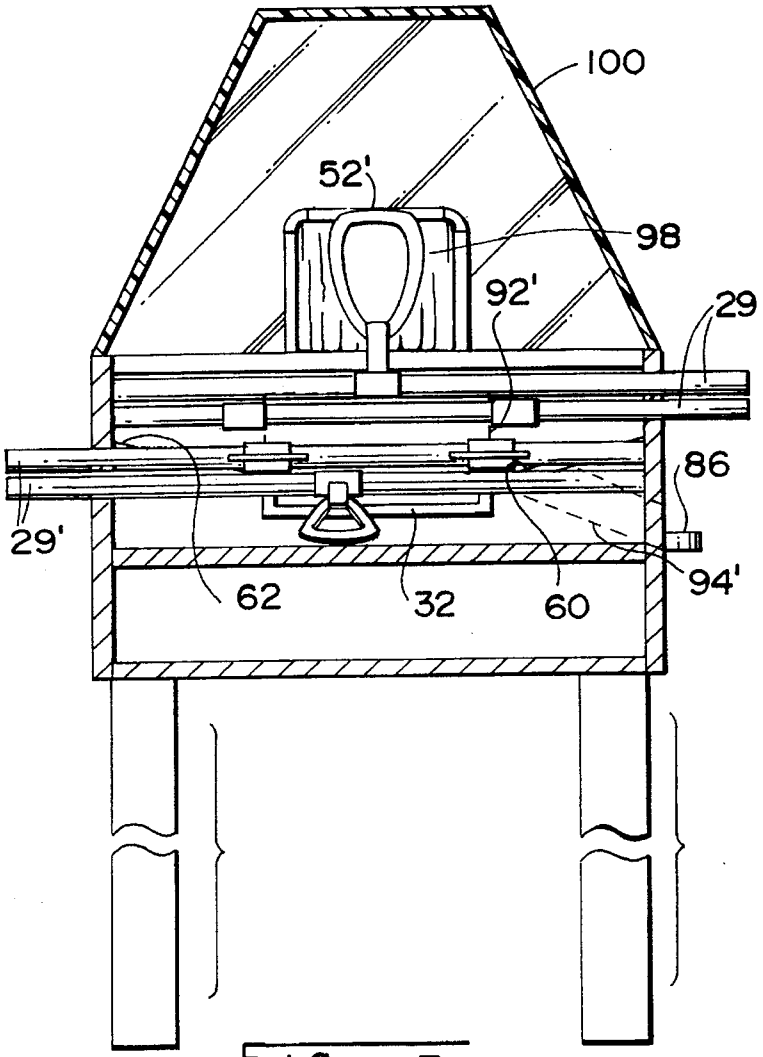
FIG. 3 is a diagrammatic sectional view taken along the line 3—3 in FIG. 2 and looking in the direction of the arrows.
Figure 5:
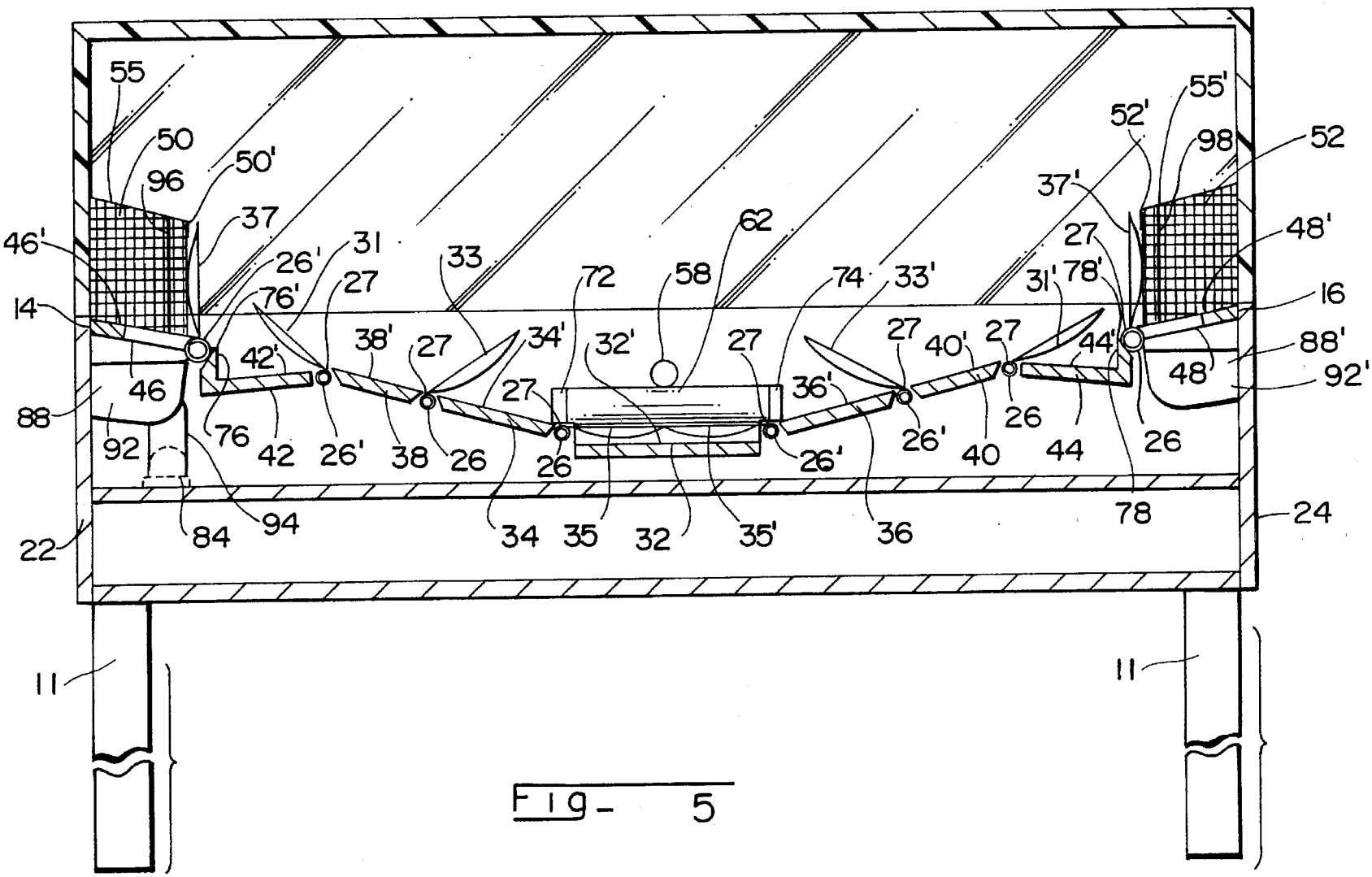
FIG. 5 is a sectional view taken along the line 5—5 in FIG. 2 and looking in the direction of the arrows.
Figure 8:
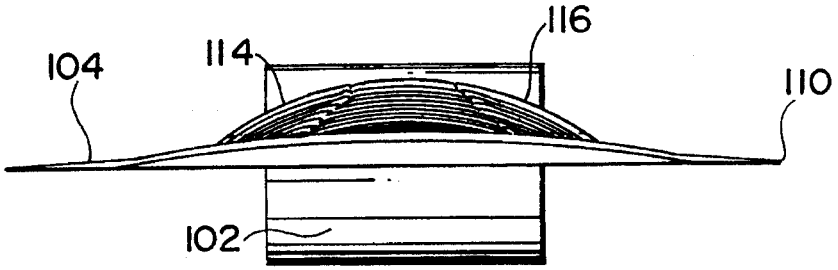
FIG. 8 is a top plan view of the ball control device shown in FIG. 6.
Figure 7:
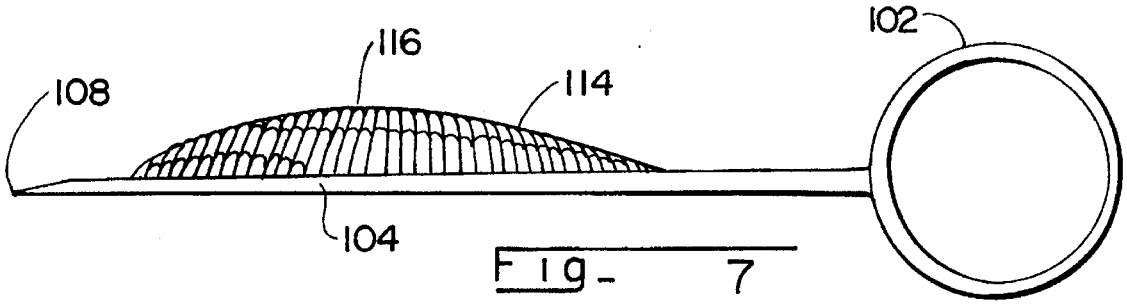
FIG. 7 is a side elevation view of the ball control device shown in FIG. 6.
Figure 6:
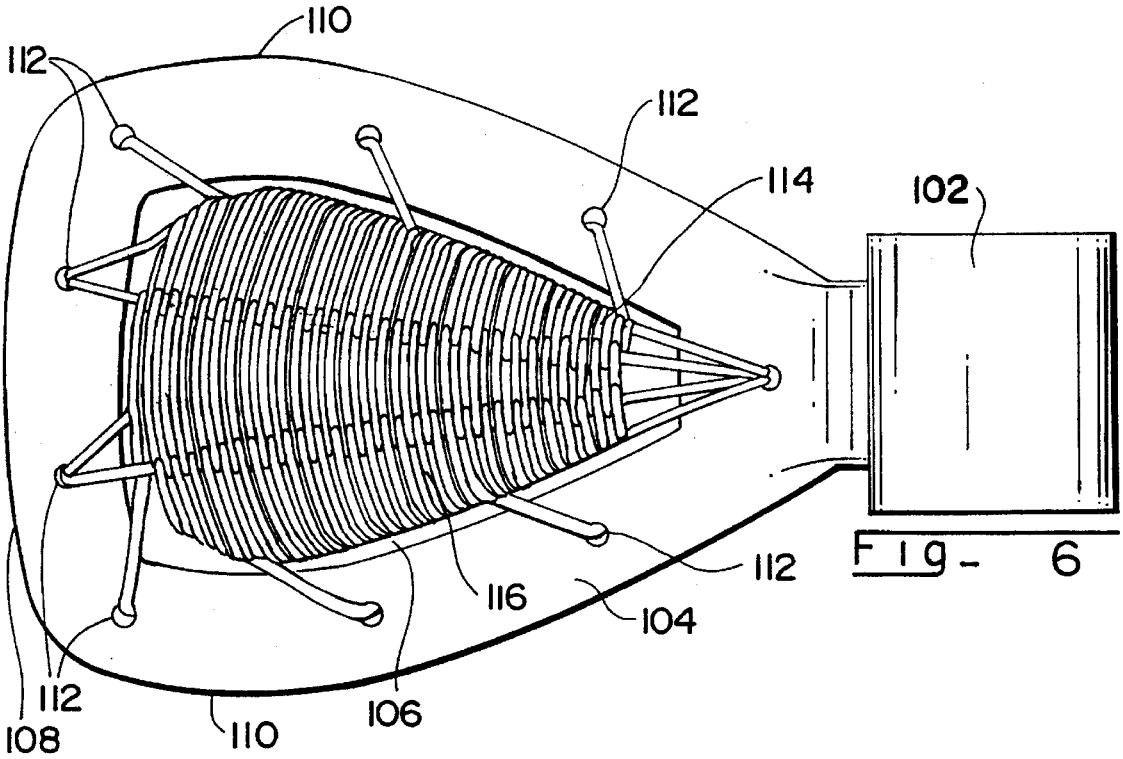
FIG. 6 is a front elevation view of a ball control device which is a part of the apparatus of this invention.

With reference now to the drawings, wherein like reference characters designate like or corresponding parts throughout the several views, there is shown a lacrosse game table apparatus 10 which includes a playing field 12 having a first end 14 and a second opposed end 16. First and second opposed side walls 18, 20 are connected to and extend upwardly above playing field 12. First and second opposed end walls 22, 24 are connected to and extend between side walls 18, 20. Walls 18, 20, 22, 24 and legs or supports 11 can be made from wood, metal, plastic or any suitable conventional material.

A plurality of hollow actuating rods 26, 26' are conventionally rotatably positioned between side walls 18, 20. Rods 26 rotatably and slideably extend through openings 28 within side walls 18 and are conventionally rotatably and slideably mounted on supporting rods (not shown) that project inwardly from side wall 20 and into the interiors of hollow rods 26. Rods 26' similarly rotatably and slideably extend through openings 28' within side wall 20 and are conventionally rotatably and slideably mounted on supporting rods (not shown) that project inwardly from side wall 18 and into the interiors of hollow rods 26'.

At least one ball control device 30 is fixedly attached to each of actuating rods 26, and at least one ball control device 30' is fixedly attached to each of actuating rods 26'.

Playing field 12 includes a plurality of spaced-apart, side-by-side playing field sections 32–48 connected to side walls 18, 20. Actuating rods 26, 26' are positioned one each directly between adjacent ones of playing field sections 32–48, and ball-receiving goal devices 50, 52 are positioned, respectively, at opposed ends 14, 16 of playing field 12. Each of playing field sections 32–48 defines an upper surface 32'–48', respectively, and each of actuating rods 26, 26' defines an upper portion 27. Upper portions 27 of actuating rods 26, 26' located between playing field sections 32–44 are positioned in alignment with upper surfaces 32'–44' so that a game ball can roll freely over actuating rods 26, 26' and over and between upper surfaces 32'–44' during playing of game apparatus 10.

In accordance with the invention, the playing field sections include first playing field section 32 positioned at a mid-field area of playing field 12, and first playing field section 32 is aligned with its upper surface 32' horizontal. A plurality of additional playing field sections 34–48 are provided which are each sloped with respect to horizontal to facilitate movement by gravity of a game ball over playing field 12 during playing of game apparatus 10.

First ones of actuating rods 26, 26' are positioned one each directly between adjacent ones of playing field sections 32–44 for enabling ball control devices 30, 30' connected to those actuating rods to contact adjacent playing field sections 32–36, 42 and 44 by rotating the actuating rods with respect to side walls 18, 20. In this manner, a game ball can be selectively collected or picked Up from playing field 12 and from playing field sections 32–36, 42 and 44, held and propelled by ball control devices 30, 30'.

Actuating rod 26' positioned between playing field sections 42, 46 and actuating rod 26 positioned between playing field sections 44, 48, are located for enabling ball control devices 30, 30' connected to those actuating rods to be positioned immediately in front of ball-receiving goal devices 50, 52, respectively, so that a game ball can be blocked from entering into and within ball-receiving goal devices 50, 52 by rotating and sliding actuating rods 26, 26' with respect to side walls 18, 20.

The plurality of additional playing field sections include a second playing field section 34 positioned between first playing field section 32 and first end 14 of playing field 12, and second playing field section 34 is sloped downwardly away from first end 14 and toward first playing field section 32.

The plurality of additional playing field sections further include a third playing field section 36 positioned between first playing field section 32 and second end 16 of playing field 12, and third playing field section 36 is sloped downwardly away from second end 16 and toward first playing field section 32.

The plurality of additional playing field sections further include a fourth playing field section 38 positioned between second playing field section 34 and first end 14 of playing field 12, and fourth playing field section 38 is sloped downwardly away from first end 14 and toward second playing field section 34.

The plurality of additional playing field sections also include a fifth playing field section 40 positioned between third playing field section 36 and second end 16 of playing field 12, and fifth playing field section 40 is sloped downwardly away from second end 16 and toward third playing field section 36.

The plurality of additional playing field sections further include a sixth playing field section 42 positioned between fourth playing field section 38 and first end 14 of playing field 12, and sixth playing field section 42 is sloped downwardly away from fourth playing field section 38 and toward first end 14.

The plurality of additional playing field sections also include a seventh playing field section 44 positioned between fifth playing field section 40 and second end 16 of playing field 12, and seventh playing field section 44 is sloped downwardly away from fifth playing field section 40 and toward second end 16.

The plurality of additional playing field sections further include an eighth playing field section 46 positioned between sixth playing field section 42 and first end 14 of playing field 12, and eighth playing field section 46 is sloped downwardly away from first end 14 and toward sixth playing field section 42.

The plurality of additional playing field sections further include a ninth playing field section 48 positioned between seventh playing field section 44 and second end 16 of playing field 12, and ninth playing field section 48 is sloped downwardly away from second end 16 and toward seventh playing field section 44.

First ball-receiving goal device 50 is mounted on eighth playing field section 46, and second ball-receiving goal device 52 is mounted on ninth playing field section 48.

First and second side walls, 18, 20 define first and second game ball introducing openings 56, 58, respectively, therein. A first ramp 60 is positioned beneath first game ball introducing opening 56 and extends between first side wall 18 and first playing field section 32 for directing a game ball introduced through opening 56 downwardly onto first playing field section 32. Similarly, a second ramp 62 is positioned beneath second game ball introducing opening 58 and extends between second side wall 20 and first playing field section 32 for directing a game ball introduced through opening 58 downwardly onto first playing field section 32.

Ramp 60 defines opposed side edges 64, 64', and second ramp 62 defines opposed side edges 66, 66'. First and second opposed wall elements 68, 70 extend inwardly from first side wall 18 and project upwardly from side edges 64, 64', respectively. Third and fourth opposed wall elements 72, 74 extend inwardly from second side wall 20 and project upwardly from side edges 66, 66', respectively.

First wall element 68 and third wall element 72 are positioned directly above a first actuating rod 26, which is located between playing field sections 32 and 34. Similarly, second wall element 70 and fourth wall element 74 are positioned directly above a second actuating rod 26', which is located between playing field sections 32 and 36.

A first back wall 76 defines a top edge 76' and projects upwardly from upper surface 42' of sixth playing field section 42. Similarly, a second back wall 78 defines a top edge 78' and projects upwardly from upper surface 44' of seventh playing field section 44.

Ball control devices 30, 30' attached to first and second actuating rods 26, 26' are center ball control devices 35, 35' and are dimensioned to selectively contact each other as first and second actuating rods 26, 26' are rotated so that checking or striking of an opponent's ball control device 35, 35' can be accomplished to dislodge a game ball or to disrupt passes or shots of an opponent.

First and second side walls 18, 20 define first and second ball exit openings 80, 82, respectively, therein, and first and second ball-receiving trays 84, 86 are attached to side walls 18, 20 beneath ball exit openings 82, 80, respectively. Means 88, 88' are provided in operative relationship with ball-receiving goal devices 50, 52 and with trays 84, 86 for enabling a game ball to be transported to trays 84, 86 from ball-receiving goal devices 50, 52, respectively. Transporting means 88, for example, preferably includes a first goal opening 90 within playing field section 46 and positioned within goal device 50. An open-topped container or box 92 is positioned beneath opening 90 to allow a game ball to drop through opening 90 and into box 92. Box 92 is tilted and a return pipe or tube 94 is connected between a lower end of box 92 and tray 84 to allow a game ball to roll from box 92 down return pipe or tube 94 to tray 84.

A similar arrangement is provided for returning a game ball from goal device 52 to tray 84. An opening 91 is provided within playing field section 48 and a box 92' is positioned beneath opening 91. A return pipe or tube 94' allows a game ball to roll down to tray 86.

A first curtain 96 is positioned and hung within first ball-receiving goal device 50 for preventing rebounds of the game ball when the game ball enters into goal device 50. As the ball strikes curtain 96, the ball is directed downwardly through opening 90 and ultimately to ball-receiving tray 84. A second curtain 98 is similarly positioned within second goal device 52. Each of curtains 96, 98 preferably is weighted at the bottom to allow the curtains to return to vertical positions after being struck by a game ball.

A transparent dome 100 projects upwardly from side walls 18, 20 and from end walls 22, 24 for preventing escape of a game ball and for preventing touching of a game ball by players during play.

In accordance with the invention, each of ball control devices 30, 30' is configured in the manner of a conventional lacrosse stick. Each of ball control devices 30, 30' includes a collar 102 attaching the ball control devices to one of actuating rods 26, 26' in a conventional manner by means of screws or other conventional fasteners. A frame 104 is connected to collar 102 and defines a central opening 106 and top and side edges 108, 110, respectively. Frame 104 further defines a plurality of additional openings 112. A string 114, preferably nylon, is strung onto frame 104 in conventional, authentic lacrosse stick style with string 114 passing through openings 112 and forming a game ball receiving pocket 116 in cooperation with central opening 106.

Top and side edges 108, 110 of each of frames 104 of each of ball control devices 30, 30' which are not positioned immediately in front of goal devices 50, 52 are bevelled to sharp edges to facilitate cutting or slicing under a game ball when picking up or scooping up the game ball off of playing field 12 and playing field sections 32–36, 42 and 44.

Ball control devices 30, 30', which are positioned immediately in front of goal devices 50, 52, are goal ball control devices 37, 37' which are preferably dimensioned to contact goal devices 50, 52 upon selective movement of the actuating rods mounting goal ball control devices 37, 37'. This will prevent goal ball control devices 37, 37' from being moved into and within goal devices 50, 52. Specifically, each of goal ball control devices 37, 37' is sized so that they will strike upper crossbar portions 50', 52' of goal devices 50, 52, respectively.

As shown and described, four of actuating rods 26 are positioned for use by one player and four actuating rods 26' are positioned for use by an opposing player. An extension of each actuating rod 26 projects through side wall 18 and is a hand control handle 29. Similarly, an extension of each actuating rod 26' extends through side wall 20 and acts as a hand control handle 29'. Hand control handles 29, 29' can be drawn or pushed and rotated by the players to cause ball control devices or miniature lacrosse sticks 30, 30' to pick up a game ball from the surface of playing field 12, block opposing passes or shots, pass the game ball to other sticks of the player, catch passes from other miniature lacrosse sticks, or shoot a game ball at goal devices 50, 52. Goal ball control devices 37, 37' positioned immediately in front of goal devices 50, 52 cannot pass the game ball but can block shots and errant passes and can direct the game ball downwardly onto and along the surface of playing field 12 to defensive miniature lacrosse sticks 31, 31' positioned immediately adjacent to goal ball control devices 37, 37'.

Although playing field 12 is described as comprising nine playing field sections 32–48 and eight actuating rods 26, 26', it should be understood that more or fewer than nine playing field sections and eight actuating rods could be used. However, it is considered that the optimum number of playing field sections to be used is nine and the optimum number of actuating rods is eight. A game ball can be picked up or scooped up by various ones of ball control devices 30, 30' from each of playing field sections 32–36, 42 and 44. Playing field sections 38, 40 merely cause the game ball to roll and the game ball cannot be picked up by ball control devices 30, 30' from playing field sections 38, 40.

Back walls 76, 78 cooperate with upper surfaces 42', 44' of playing field sections 42, 44 to allow defensive miniature lacrosse sticks 31, 31' to pick up or scoop the game ball from playing field sections 42, 44, respectively.

Wall elements 68, 72 cooperate with upper surface 34' to allow offensive miniature lacrosse sticks 33 to trap and pick up or scoop a game ball from playing field section 34. Similarly, wall elements 70, 74 cooperate with upper surface 36' to allow offensive miniature lacrosse sticks 33' to trap and pick up or scoop a game ball from playing field section 36.

Wall elements 68, 72 also cooperate with ramps 60, 62, respectively, to enable center ball control device or lacrosse stick 35 to trap a game ball and to pick or scoop up a game ball. In a similar manner, wall elements 70, 74 cooperate with ramps 60, 62, respectively, to enable center ball control device or lacrosse stick 35' to trap a game ball and to pick or scoop up a game ball.

Although not shown, each of actuating rods 26, 26' can be provided with stops for limiting axial movement of rods 26, 26' to avoid damage to ball control devices 30, 30'. Top portions 55, 55' of goal devices 50, 52 are sloped downwardly away from ends 14, 16, respectively, of playing field 12 to enable a game ball to roll back onto the playing field if it lands on top portions 55, 55'.

In operation and use of apparatus 10, a game ball is introduced through one of openings 56, 58. The game ball will then roll downwardly along ramp 60 or 62 onto surface 32' of mid-field playing section 32. The opposing players can then manipulate center miniature lacrosse sticks 35, 35' to pick up the ball by rotating and pushing or pulling actuating rods 26, 26' connected to central miniature lacrosse sticks 35, 35'. Because of the dimensions of sticks 35, 35', they can contact each other so that checking or striking of an opponent's stick 35, 35' can be accomplished to dislodge a game ball from stick 35 or 35' or to disrupt passes or shots of an opponent from stick 35 or 35'.

When the game ball is controlled and held within a pocket 116 of one of central miniature lacrosse sticks 35, 35', the game ball can then be passed to another offensive miniature lacrosse stick 33 or 33' or the game ball can be shot at one of goal devices 50, 52. The game ball can be caught, blocked and/or passed by defensive miniature lacrosse sticks 31, 31', and the game ball can be blocked by goal miniature lacrosse sticks 37, 37'. Goal sticks 37, 37' cannot pass the game ball because movement of goal sticks 37, 37' is restricted by contacting upper crossbars 50', 52' of goal devices 50, 52. However, goal sticks 37, 37' can guide or direct the game ball along the surface of playing field 12 to defensive sticks 31, 31'.

If a shot causes the game ball to enter into and within one of goal devices 50, 52, weighted curtains 96, 98 positioned just within each of goal devices 50, 52 prevents the game ball from rebounding out of the goal devices. Curtains 96, 98 guide the game ball downwardly through openings 90, 91 in playing field sections 46, 48, respectively. The game ball will then drop into open-topped game ball return box 92, 92', and the game ball will then move by gravity through return pipe or tube 94, 94' to ball-receiving tray 84 or 86.

Ball control devices or miniature lacrosse sticks 30, 30' are preferably constructed from durable, flexible plastic. Dome 100 is a hard, clear plastic or glass dome which keeps the game ball in play and protects the apparatus parts from touching by the players.

The invention in its broader aspects is not limited to the specific details shown and described, and departures may be made from such details without departing from the principles of the invention and without sacrificing its chief advantages.

What is claimed is:

1. A lacrosse game apparatus, comprising:

a playing field having first and second opposed ends;

first and second opposed side walls connected to and extending upwardly above said playing field;

first and second opposed end walls connected to and extending between said side walls;

a plurality of actuating rods extending between and rotatably and slideably positioned with respect to said side walls;

at least one ball control device fixedly attached to each of said actuating rods;

said playing field including a plurality of spaced-apart, side-by-side playing field sections connected to said side walls;

said actuating rods positioned one each substantially directly between adjacent ones of said playing field sections; and first and second ball-receiving goal devices positioned, respectively, at said opposed ends of said playing field.

2. Apparatus as in claim 1 wherein each of said playing field sections defines an upper surface, wherein each of said actuating rods defines an upper portion, and wherein said upper portions of predetermined ones of said actuating rods are positioned in substantial alignment with said upper surfaces of predetermined ones of said playing field sections, whereby a game ball can roll freely over said predetermined ones of said actuating rods and over said upper surfaces of said predetermined ones of said playing field sections during playing of the game apparatus.

3. Apparatus as in claim 2 wherein said playing field sections include:

a first said playing field section positioned at a substantially mid-field area of said playing field and wherein said first playing field section is substantially horizontal; and a plurality of additional said playing field sections sloped with respect to horizontal to facilitate movement by gravity of a game ball during playing of the game apparatus.

4. Apparatus as in claim 3 wherein first predetermined ones of said actuating rods are positioned for enabling first predetermined ones of said ball control devices to contact predetermined ones of said playing field sections by rotating said predetermined actuating rods in predetermined manners with respect to said side walls, whereby a game ball can be selectively collected from said playing field, held and propelled by said first predetermined ball control devices.

5. Apparatus as in claim 4 wherein second predetermined ones of said actuating rods are positioned for enabling second predetermined ones of said ball control devices to be positioned immediately in front of said first and second ball-receiving goal devices, whereby a game ball can be blocked from entering into and within said first and second ball-receiving goal devices by rotating and sliding said second predetermined ones of said actuating rods with respect to said side walls.

6. Apparatus as in claim 5 wherein said plurality of additional said playing field sections include:

a second said playing field section positioned between said first playing field section and said first end of said playing field and wherein said second playing field section is sloped downwardly away from said first end of said playing field and toward said first playing field section; and a third said playing field section positioned between said first playing field section and said second end of said playing field and wherein said third playing field section is sloped downwardly away from said second end of said playing field and toward said first playing field section.

7. Apparatus as in claim 6 wherein said plurality of additional said playing field sections further include:

a fourth said playing field section positioned between said second playing field section and said first end of said playing field and wherein said fourth playing field section is sloped downwardly away from said first end of said playing field and toward said second playing field section; and a fifth said playing field section positioned between said third playing field section and said second end of said playing field and wherein said fifth playing field section is sloped downwardly away from said second end of said playing field and toward said third playing field section.

8. Apparatus as in claim 7 wherein said plurality of additional said playing field sections further include:

a sixth said playing field section positioned between said fourth playing field section and said first end of said playing field and wherein said sixth playing field section is sloped downwardly away from said fourth playing field section and toward said first end of said playing field; and a seventh said playing field section positioned between said fifth playing field section and said second end of said playing field and wherein said seventh playing field section is sloped downwardly away from said fifth playing field section and toward said second end of said playing field.

9. Apparatus as in claim 8 wherein said plurality of additional said playing field sections further include:

an eighth said playing field section positioned between said sixth playing field section and said first end of said playing field and wherein said eighth playing field section-is sloped downwardly away from said first end of said playing field and toward said sixth playing field section; and a ninth said playing field section positioned between said seventh playing field section and said second end of said playing field and wherein said ninth playing field section is sloped downwardly away from said second end of said playing field and toward said seventh playing field section.

10. Apparatus as in claim 9 wherein said first ball-receiving goal device is mounted on said eighth playing field section.

11. Apparatus as in claim 10 wherein said second ball-receiving goal device is mounted on said ninth playing field section.

12. Apparatus as in claim 11 wherein said first and second side walls define first and second game ball introducing openings, respectively.

13. Apparatus as in claim 12 further including:

a first ramp positioned beneath said first game ball introducing opening and extending between said first side wall and said first playing field section for directing a game ball introduced through said first game ball introducing opening downwardly onto said first playing field section; and a second ramp positioned beneath said second game ball introducing opening and extending between said second side wall and said first playing field section for directing a game ball introduced through said second game ball introducing opening downwardly onto said first playing field section.

14. Apparatus as in claim 13 wherein each of said first and second ramps defines side edges and further including:

first and second opposed wall elements extending inwardly from said first side wall and projecting upwardly from said side edges of said first ramp; and third and fourth opposed wall elements extending inwardly from said second side wall and projecting upwardly from said side edges of said second ramp.

15. Apparatus as in claim 14 wherein said first and said third wall elements are positioned substantially directly above a first rod of said first predetermined ones of said actuating rods and wherein said second and said fourth wall elements are positioned substantially directly above a second rod of said first predetermined ones of said actuating rods.

16. Apparatus as in claim 15 further including:

a first back wall defining a top edge and projecting upwardly from said sixth playing field section; and a second back wall defining a top edge and projecting upwardly from said seventh playing field section.

17. Apparatus as in claim 16 wherein said ball control devices attached to said first and second rods are dimensioned to enable said last-mentioned ball control devices to selectively contact each other as said first and second rods are rotated, whereby checking or striking of an opponent's ball control device to dislodge a game ball or to disrupt passes or shots of an opponent can be accomplished.

18. Apparatus as in claim 17 wherein said first and second side walls define first and second ball exit openings, respectively, and further including:

first and second ball-receiving trays attached to said first and second side walls and beneath said first and second ball exit openings, respectively; and means in operative relationship with said first and second ball-receiving goal devices and with said trays for enabling a game ball to be transported to said trays from within said ball-receiving goal devices.

19. Apparatus as in claim 18 further including:

a first curtain positioned within said first ball-receiving goal device for preventing rebounds of a game ball when it enters said first ball-receiving goal device and strikes said first curtain; and a second curtain positioned within said second ball-receiving goal device for preventing rebounds of a game ball when it enters said second ball-receiving goal device and strikes said second curtain.

20. Apparatus as in claim 19 further including a transparent dome projecting upwardly from said side walls and from said end walls for preventing escape of a game ball and for preventing touching of a game ball by players during play.

21. Apparatus as in claim 5 wherein each of said ball control devices is configured substantially in the manner of a conventional lacrosse stick.

22. Apparatus as in claim 21 wherein each of said ball control devices include:

a collar attaching said ball control device to one of said actuating rods;

a frame connected to said collar and defining a central opening and top and side edges and further defining a plurality of additional openings; and nylon string strung on said frame in conventional, authentic lacrosse stick style with said string passing through said plurality of additional openings and forming a game ball receiving pocket in cooperation with said central opening.

23. Apparatus as in claim 22 wherein said top and side edges of said frames of said first predetermined ones of said ball control devices are bevelled to sharp edges to facilitate cutting or slicing under a game ball when picking or scooping the game ball off of said playing field.

24. Apparatus as in claim 23-wherein said first predetermined ones of said ball control devices attached to said actuating rods that are positioned immediately next to said first playing field section are dimensioned to permit selective contact of said last-mentioned ball control devices with each other whereby checking or striking of an opponent's ball control device to dislodge a game ball or to disrupt passes or shots of an opponent can be accomplished.

25. Apparatus as in claim 24 wherein said second predetermined ones of said ball control devices are goal ball control devices positioned one each immediately in front of each of said ball-receiving goal devices and wherein said goal ball control devices are dimensioned to contact said goal devices upon selective movement of said second predetermined ones of said actuating rods to prevent said goal ball control devices from being moved into and within said ball-receiving goal devices.

26. Apparatus as in claim 1 wherein said first ball-receiving goal device defines a first top portion which is sloped downwardly away from said first end of said playing field and wherein said second ball-receiving goal device defines a second top portion which is sloped downwardly away from said second end of said playing field, whereby a game ball will roll back onto said playing field from said first and second top portions of said ball-receiving goal devices.

27. Apparatus as in claim 18 wherein said means for enabling a game ball to be transported to said trays from said ball-receiving goal devices include:

first and second goal openings defined within each of said eighth playing field section and said ninth playing field section and within said first and second goal devices, respectively;

first and second open-topped containers positioned beneath said first and second goal openings, respectively, for receiving a game ball dropping through said goal openings; and first and second pipes connected between said first container and said first ball-receiving tray and between said second container and said second ball-receiving tray, respectively, to allow a game ball to roll from said containers to said ball-receiving trays.

* * * * *